United States Patent [19]

Howard et al.

[11] Patent Number: 4,705,175

[45] Date of Patent: Nov. 10, 1987

[54] DISPLAY AND PULL-OUT TRAY ASSEMBLIES FOR INTEGRATED MODULAR STORE FIXTURE SYSTEM

[75] Inventors: Fred Howard, New York; Sydney Edson, East Meadow, both of N.Y.

[73] Assignee: Sara Lee Corporation, Winston-Salem, N.C.

[21] Appl. No.: 15,147

[22] Filed: Feb. 17, 1987

[51] Int. Cl.[4] ..... A47F 5/00

[52] U.S. Cl. ..... 211/59.2; 108/109; 211/59.1; 211/126; 211/193

[58] Field of Search ..... 211/59.1, 59.2, 59.3, 211/57.1, 193, 126, 133, 151, 187, 182; 108/108, 109

[56] References Cited

U.S. PATENT DOCUMENTS 3,355,134 11/1967 Chesley ..... 108/108 X
4,250,815 2/1981 Swanson ..... 211/182 X
4,531,646 7/1985 Howard ..... 211/59.2

FOREIGN PATENT DOCUMENTS 641743 5/1962 Canada ..... 211/59.2
2412290 8/1979 France .

*Primary Examiner*—Robert W. Gibson, Jr.
*Attorney, Agent, or Firm*—McAulay, Fields, Fisher, Goldstein & Nissen

[57] ABSTRACT

An integrated modular store fixture system has at least two spaced apart parallel vertical members at the rear of the system with side surfaces facing each other and having a series of aligned holes therein. A display assembly or a pull-out tray assembly is engageable with holes into members for holding merchandise to be displayed at the front of the system. The assemblies include two side support elements, each extending from the rear to the front of the system when in the mounted position with one end at the rear having members projecting transverse to the support elements and each projecting member inserted into one hole in one vertical member. The side support elements are releasably retained in the mounted position by a horizontal elongated stretcher member having downwardly depending pins and which are slidably received in tubular members on each support element. A tray or J-hook is mounted on the support elements for holding merchandise to be displayed.

16 Claims, 14 Drawing Figures

321
324
34
322
140
38
323
325

324
34
321

323
34
324
325
321
322
326
38
39
40

37
35
36

92
9
91

DISPLAY AND PULL-OUT TRAY ASSEMBLIES FOR INTEGRATED MODULAR STORE FIXTURE SYSTEM

BACKGROUND OF THE INVENTION

The present invention relates to a modular store fixture system designed to display packaged goods in multiple sections, each section having a plurality of trays or other display assemblies to store and dispense products on display.

A modular store fixture system of this type is disclosed in copending U.S. application Ser. No. 883,586, filed July 9, 1986, the contents of which are incorporated herein by reference.

In the known modular store fixture system, a product presentation is enabled which is based on the rate of sale, making for better management of the category. The system is provided with a plurality of C-shaped rigid frame members, each having two horizontal arms and a vertical spine connecting the two arms. A plurality of rigid spacer elements connect the frame members together in a spaced apart parallel relationship and trays for holding merchandise to be displayed are mounted between successive spines or vertical members. Each of the spines or vertical members comprises side surfaces having a series of aligned holes spaced apart at a center-to-center distance of about ½". The tray and display assemblies coact with the aligned holes to be mounted in place.

SUMMARY OF THE INVENTION

The main object of the present invention is to provide an improved assembly for mounting a display or tray which can be easily and quickly mounted in place and removed as necessary.

Another object of the present invention is to provide a pull-out tray assembly which enables each tray to be displaced outwardly from the modular store fixture while still mounted in place to facilitate rotation of inventory in each tray. This is particularly important to permit the retailer to place freshly received merchandise behind merchandise already on display and to easily access the entire length of the tray in order to stock the trays with product.

These and other objects and advantages of the present invention are achieved in accordance with the present invention by two side support elements engageable in the holes in two of the parallel vertical members. Each support element extends from the rear to the front of the system when in a mounted position, with one end at the rear having means forming members projecting transverse to the support elements.

Each projecting member is inserted in one hole in one vertical member and means are provided for releasably retaining the side support elements in the mounted position comprising a horizontal elongated stretcher member having two downwardly depending pins and means disposed on each side support element for slidably receiving one pin. Means are then mounted on the side support elements for holding merchandise to be displayed.

In the case of the display assembly, each side support element comprises a wire frame having a rear portion comprising a right triangle and a linear front portion extending downwardly from the hypotenuse of the aforementioned triangle to a free end.

The means forming the projecting members for each side of the element comprises a C-shaped wire member having two arms extending from a connecting member and the connecting member forms one side of the triangle and the two arms form the projecting members.

The stretcher member is mounted between the two side support element by providing a tubular member affixed to each connecting member and disposed in parallel therewith. The stretcher member comprises a C-shaped elongated wire member having two arms forming the pins and configured to be received in the tubular members and a portion connecting the two arms.

In a particular preferred commercial embodiment, the means for holding the merchandise to be displayed comprises a bar connecting the free ends of the front portions of the wire frames and at least one J-hook, which is releasably engageable with the bar for holding merchandise to be displayed.

The display assembly as described is assembled by first disposing each of the side support elements between the vertical members with the projecting members inserted into holes in the vertical members. Once the side support members are in their mounted position, the stretcher member is inserted therebetween with the two pins of the stretcher member inserted into the tubular members of the side support elements. Since the stretcher member prevents any inward movement of the side support elements, the assembly is held firmly in place.

The J-hooks can now be releasably engaged with the bar at the front of the assembly and product packages can be mounted on the J-hooks as desired.

For the pull out tray assembly, each side support element has an inside face and means forming a slide channel which slopes downwardly from the rear to the front of the system. A detent is provided along the slide channel at a lower front portion thereof.

The tray for holding merchandise to be displayed has two slide members at both sides and under the base of the tray which are respectively slidably received in the slide channels of two side support elements. One slide member is disposed at the front portion at both sides of the tray and one slide member is disposed at the rear portion at both sides of the tray. The slide members are resilient and each includes a rear portion parallel to the base and a front portion depending downwardly from the rear portion at an acute angle and each has a leading edge coactive with the detent to prevent forward movement of the tray. The leading edge is manually bendable upwardly to move the leading edge above the detent and permit forward movement of the tray. As a result, the tray is movable between a display position wherein the slide members at the front portion of the tray coact with the detents and a loading position wherein the slide members at the rear portion of the tray coact with the detents. In the loading position, the tray is forward and the products therein can be rotated as desired.

In a particularly advantageous commercial embodiment, the means forming the slide channel includes means forming a relaxation area in the channel at a rear portion thereof and comprises a widening of the channel. The relaxation area corresponds to the position of the front portions of the rear slide members when the tray is in the display position. This enables the slide members to remain in the downwardly depending position during the time when the tray is in the display position which is a majority of the time of use of the display. In this way, the channel will not exert any force on the rear slide members so that the resiliency thereof will not be diminished.

The side support elements preferably comprise an integral plastic member comprising the means forming a slide channel and detents. The plastic member includes a rear portion having a vertical channel in the inside face with two spaced apart through holes to the outside face thereof.

As in the previous embodiment, the means forming the projecting members comprises a C-shaped wire member which has the connecting member thereof received in the vertical channel and the two arms extending through the through holes to form the projecting members.

Moreover, the side support members are maintained in the mounted position by means of the same stretcher member as in the first mentioned embodiment as well as the tubular members fixed to each connecting member.

These and other objects and advantages of the present invention will be more completely disclosed with reference to the following detailed description taken with the attached drawings wherein:

DETAILED DESCRIPTION OF THE INVENTION

Figure 1:
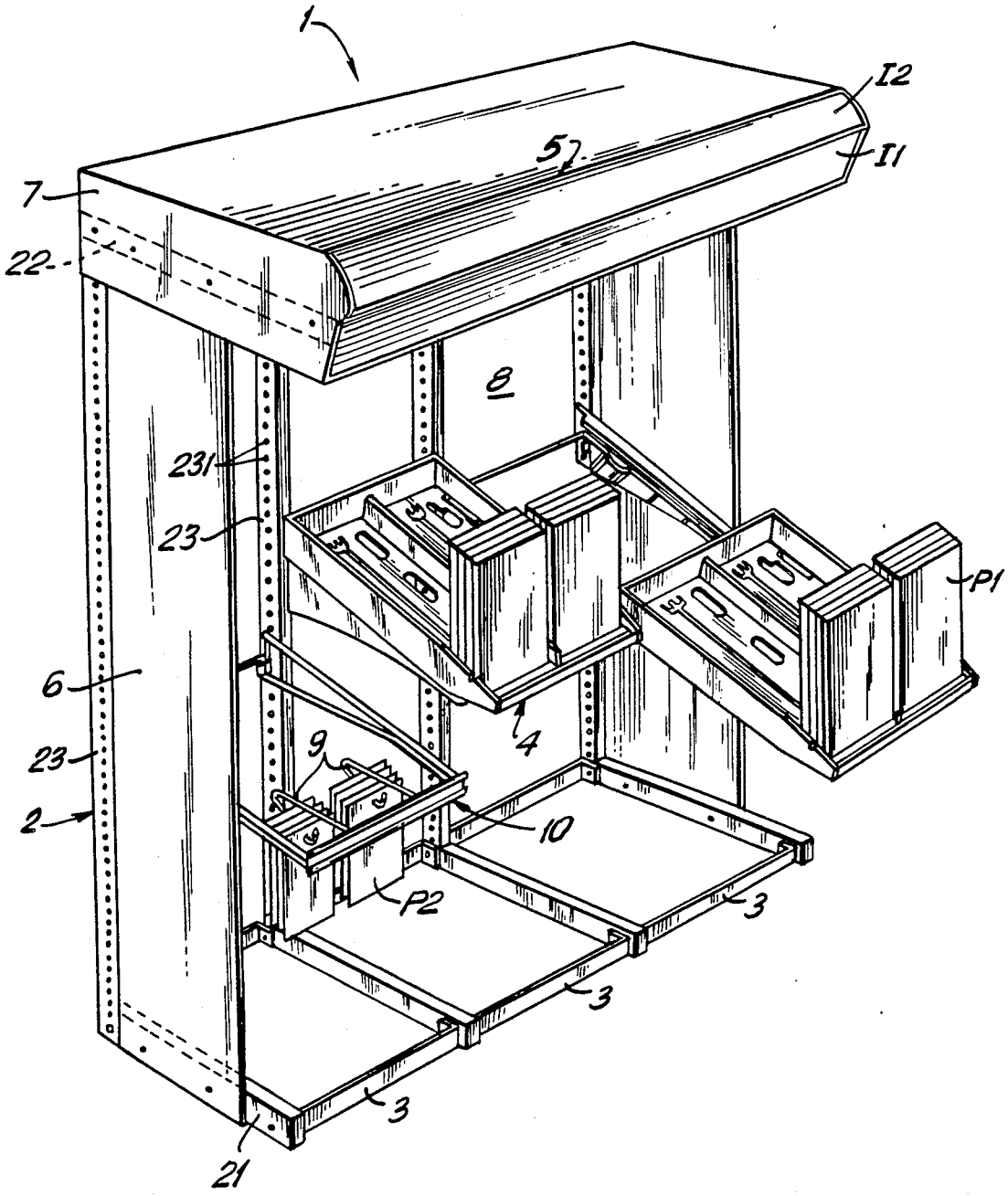
FIG. 1 is a perspective view of the integrated modular store fixture system with a display assembly and a pull-out tray assembly in accordance with the present invention.
Figures 2, 3, 4, 5, 6:
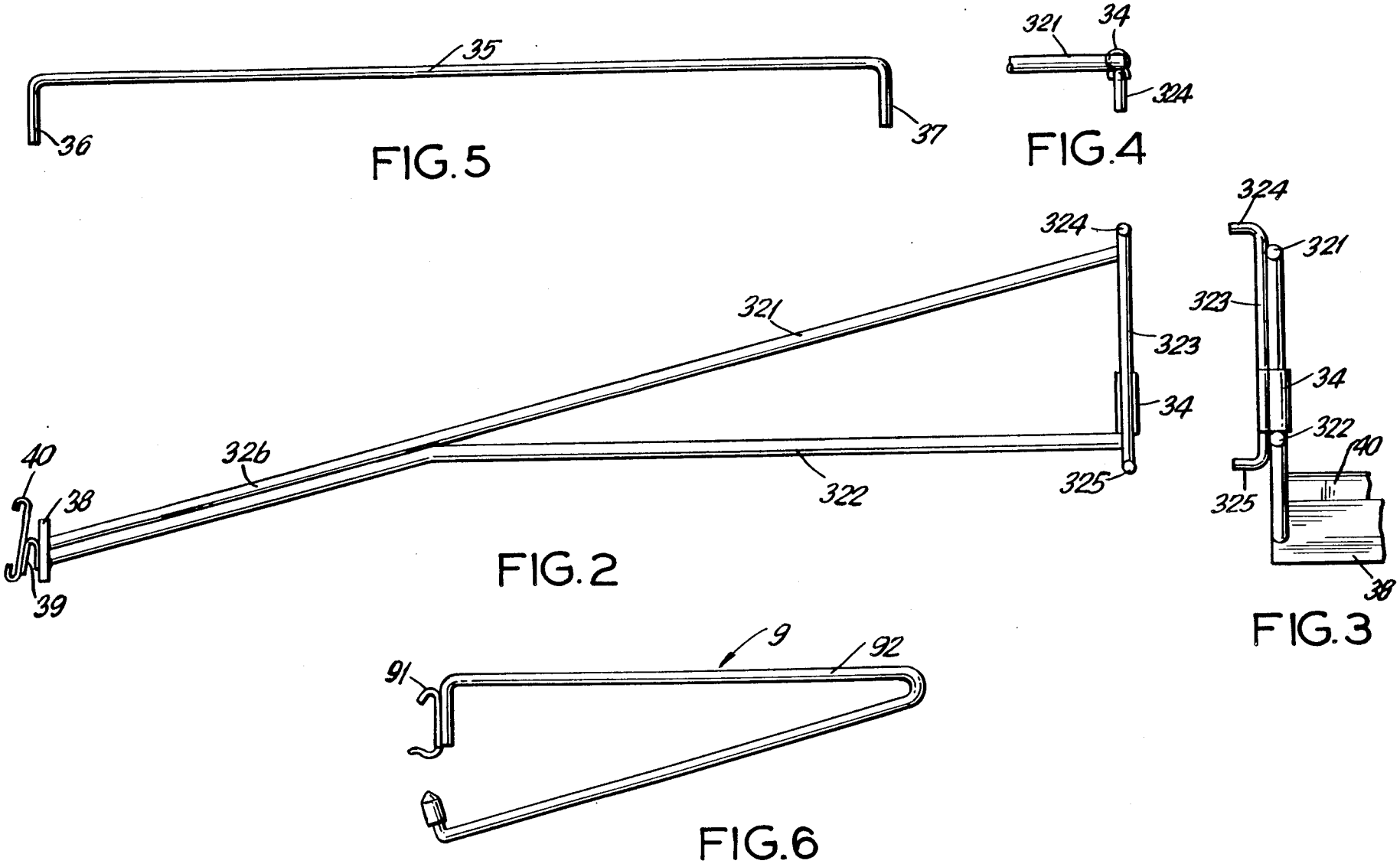
FIG. 2 is a side view of the display assembly according to the present invention.
FIG. 3 is a partial rear view of the assembly shown in FIG. 2.
FIG. 4 is a partial top view of the assembly shown in FIG. 2.
FIG. 5 is a front view of the stretcher member for the assembly of FIG. 2.
FIG. 6 is a side view of a J-hook used with the assembly of FIG. 2.

FIG. 1 illustrates the integrated modular store fixture system 1 which includes a plurality of C-shaped frame members 2. The members 2 include two horizontal side arms 21 and 22, and a vertical spine 23 at a rear portion of the system. Successive frame members 2 are connected by means of three connecting members 3 at the free ends of both arms 21 and 22 and at the ends of spine 23 in order to fix the successive frame members in a spaced apart parallel relationship. The C-shaped frame members and spacer elements are disclosed in more detail in the aforementioned copending application.

The integrated modular store fixture system 1 also includes a plurality of pull-out tray assemblies 4 for holding merchandise such as packages P1 to be displayed. The trays, depending upon the size of the packages to be displayed, can be disposed at different vertical spacings and can have different width slides therein. For the sake of clarity, only two trays are shown with only two slides each. The system also includes a J-hook display assembly 10 for J-hooks 9 which mount packages P2. The display assembly will be disclosed hereinafter with regard to FIGS. 2–7 and the tray assembly will be disclosed hereinafter with regard to FIGS. 8–14.

Also included in the system is a display header assembly 5 which is used to hold brand information cards I1 in the lower portion thereof and store information cards I2 in the upper portion thereof. The details of the header unit are described in the aforementioned copending application.

Th system also may include side panels 6, header side panels 7 and the rear panel 8 for closing off the unit and to provide it with a more attractive appearance.

The display assembly 10 is shown in FIGS. 1–7 and comprises two side support elements 31 and 32 each having a rear triangle portion 31*a*, 32*a* and a front linear portion 31*b*, 32*b*. The rear portions 31*a*, 32*a*, include a base 312, 322, a hypotenuse 311, 321 and another side 313, 323 which is formed by the connecting portion of two C-shaped members having arms 314, 315 and 324, 325 which are insertable into the holes 231 on vertical members 23.

The front portions 31*b*, 32*b* are linear and are in effect an extension of the hypotenuse 311, 321 of the triangle with the base members 312, 322 being bent to be parallel with members 311, 321.

Figure 7:
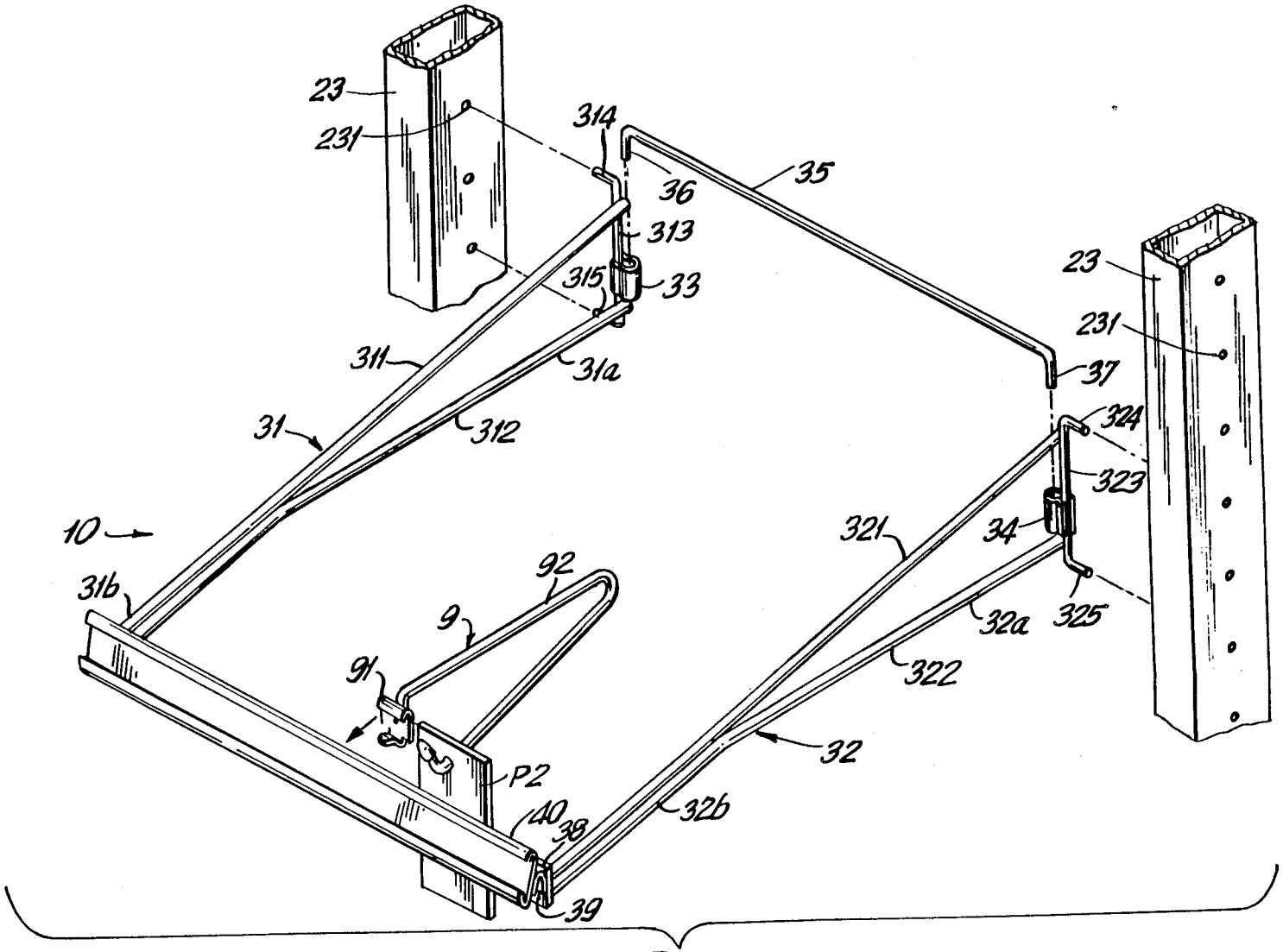
FIG. 7 is an exploded view of the display assembly in accordance with the present invention as shown in FIGS. 1–6.
Figure 9:
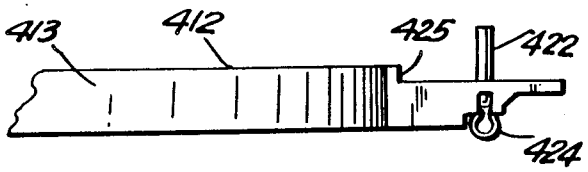
FIG. 9 is a partial top view of the side support element shown in FIG. 8.
Figure 8:
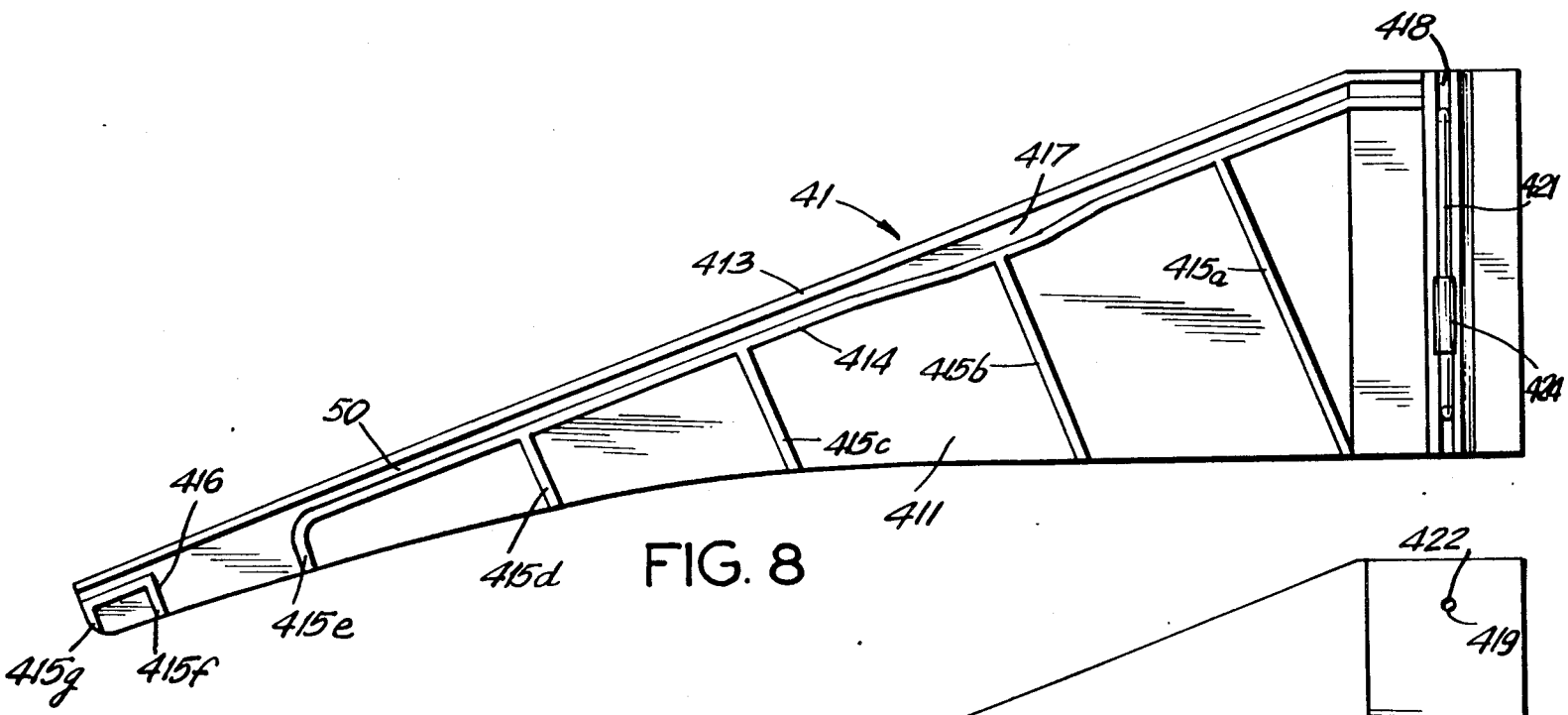
FIG. 8 is a side view of the inner face of a side support element for the pull-out tray assembly shown in FIG. 1.
Figure 10:
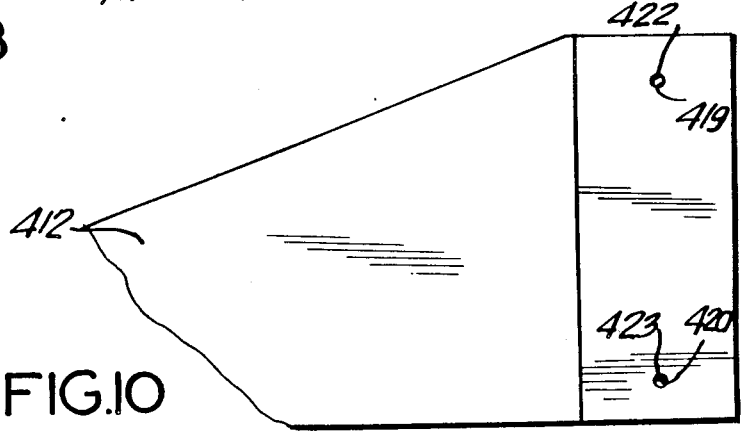
FIG. 10 is a partial side view of the outer surface of the side support element of FIG. 8.
Figure 11:
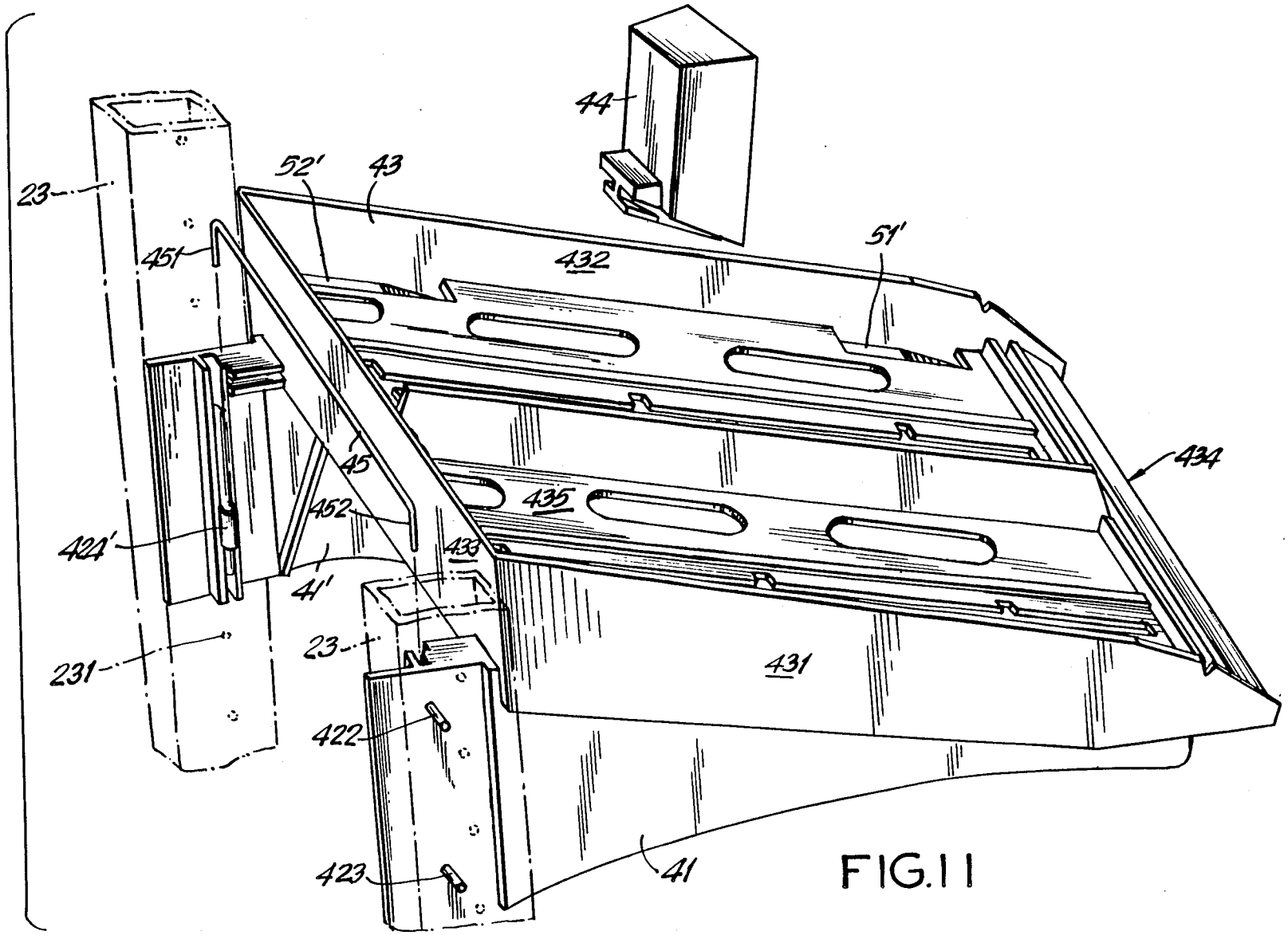
FIG. 11 is a partially exploded view of the pull-out tray assembly according to the present invention.

Aside from the fact that the side support elements 331, 332 have a triangular shape for the purposes of imparting strength, the particular configuration as shown in FIG. 7 has practical advantages as will be discussed hereinafter.

Attached to members 313, 323 are tubular elements 33, 34 which are welded to 313, 323 and are configured to receive pins 36, 37 of stretcher member 35.

The free ends of front portions 31*b*, 32*b* are connected by a bar 38 which is welded thereto. The bar is configured to be engaged by a releasable clamp 91 which is welded to a J-shaped member 92 which is part of the J-hook 9.

The price and product information can be displayed with this assembly by a price holder 40 which is welded via an intermediate member 39 to bar 38.

In use, the assembly as shown in FIG. 7 is disposed at the desired height between vertical members 23 and the side elements 31, 32 are bent slightly inwardly so that members 314, 315 and 324, 325 can be inserted into holes 231. Then the stretcher member 35 which is configured to have a length which is slightly less than the length between two members 23 has pins 36 and 37 inserted into tubular members 33, 34. Due to the rigidity of stretcher member 35, side elements 31, 32 cannot be moved inwardly and thus the assembly is now releasably secured in position.

Once the assembly is in place, at least one J-hook 9 is engaged on bar 38 and packages P2 are placed thereon for display. It should be noted that because of the downward slope of the front portion 31*b*, 32*b*, J-hook 9 can be placed as close to the side support elements 31, 32 as desired and the upper portion of packages P2 will not touch side elements 31, 32. This is advantageous since it enables the full width of the assembly to be used for displaying packaged material.

Referring now to FIGS. 1 and 8–14, the pull-out tray assembly 4 will now be disclosed in more detail.

The pull-out draw assembly essentially comprises two side support elements 41, 41' which are mirror images of one another. For this reason, only one side support element 41 will be described in detail. Side support element 41' has the same structural elements thereon but they are a mirror image of element 41. The assembly also includes stretcher element 45 with its depending pins 451 and 452, a slidable tray 43 and a push slider 44 which is described in more detail in the aforementioned copending application.

The side support element 41 has an outside face 412 and an inside face 411. On the outside face 412, there is a shoulder 425 which abuts against the front surface of vertical members 23 to assure proper fit and strength during support. The rear portion of side support element 41 includes a vertical channel 418 which has through holes 419 and 420 which extend to the outr surface 412. A C-shaped member including two projecting members 422 and 423 and a connecting portion 421 are fitted into the channel 418 and holes 419 and 420 so that members 422 and 423 project transverse to the plane of the side support element 41 and can be inserted into holes 231 in vertical members 23. Also mounted on connecting portion 421 is a tubular member 424 which is configured to receive pin 451 or 452 of stretcher 45.

In use, the two support elements are disposed in place with projecting members 422 and 423 and the corresponding ones on the side support elements 41' inserted into holes 231. Thereafter the stretcher 45 is installed in place in tubular members 424 and 424' so that the side support elements 41 and 41' cannot move inwardly and thus are releasably mounted in place.

The side support element 41 on the inside surface 411 has two vertically spaced planar portions 413 and 414 which form a guide channel 50. The inside surface 411 also includes strengthening ribs 415*a*–415*g*.

Guide channel 50 is also formed with a detent 416 at the front portion thereof and a relaxation area 417 at the rear portion thereof which is, in effect, a widening of the guide channel 50.

The slidable tray 43 comprises side walls 431 and 432, rear wall 433, a front portion 434 and a base 435.

Figure 14:
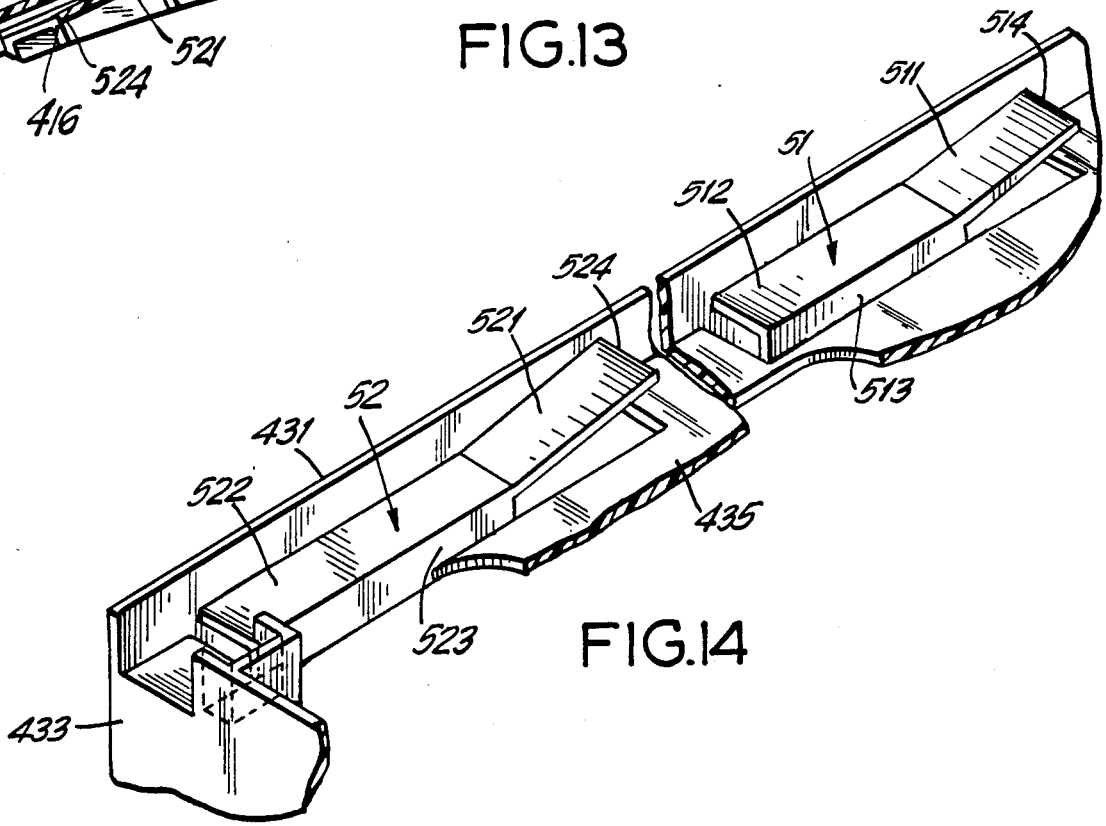
FIG. 14 is a detail of the slide members at the bottom of the tray, with the tray shown inverted.

The base 435 is formed on the underneath portion thereof, as is clearly shown in FIG. 14, with longitudinally spaced slide members 51 and 52 at one side and members 51' and 52' at the other side. For the sake of clarity, only the members 51 or 52 are shown in detail. However, it should be understood that members 51' and 52' are mirror images of the members 51 and 52.

Member 51, which is disposed at the front portion of the tray, has a rear portion which is L-shaped and includes horizontal portion 512 and a vertical portion 513 which is configured to be slidably received in guide slot 50. The member also includes a front portion 511 which is at an acute angle with regard to portion 512 and has a leading edge 514 and is resiliently bendable by hand.

Similarly, the slide member 52 at the rear portion of the tray has horizontal portion 522 and vertical portion 523 as well as the front portion 521 at an acute angle to portion 522 and having leading edge 524. Portion 521 is also manually resiliently bendable relative to portion 522.

In use, the tray is slid onto support elements 41 and 41' by inserting slide members 51, 52 and 51', 52' into guide channels 50 and 50' (not shown). The tray is then slid back into the display position corresponding to the center portion of the fixture shown in FIG. 1 and the position shown in FIG. 12. In this position, leading edge 514 abuts against detent 416 and thus prevent any forward movement of the tray relative to the element 41. At the same time the portion 521 is disposed in the area of the relaxation area 417 and thus is able to remain fully extended and thus the guide channel does not exert any force thereon which would result in the loss of resiliency or a change in the rest position of the member 521.

Figure 12:
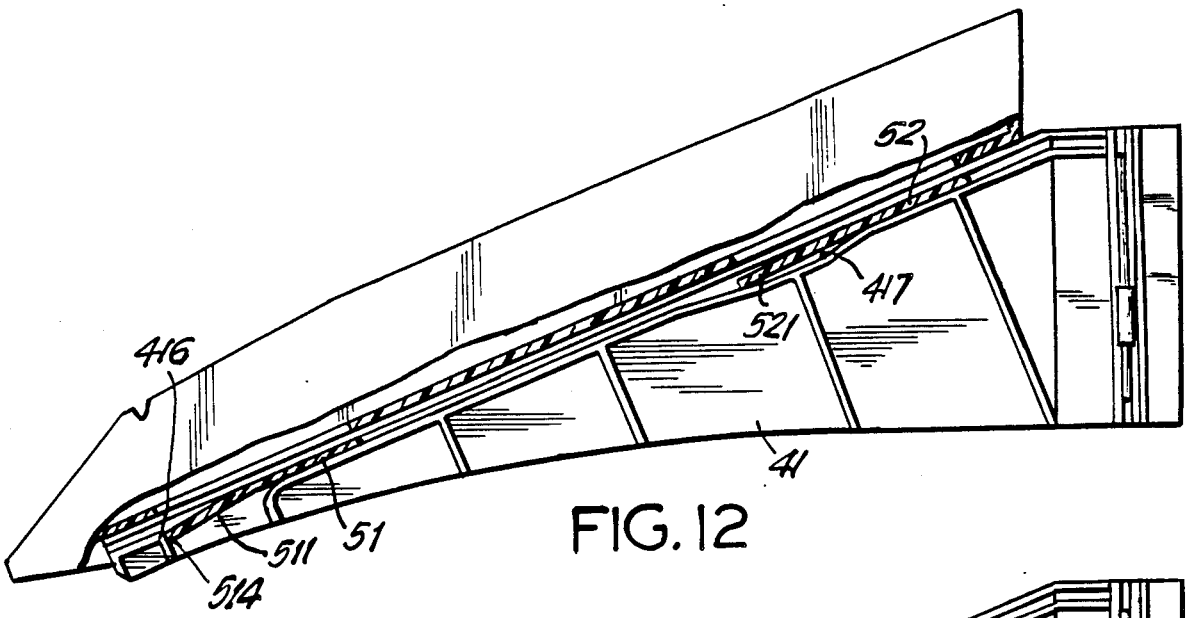
FIG. 12 is a partial sectional view showing the tray and one side support element with the tray in the display position.
Figure 13:
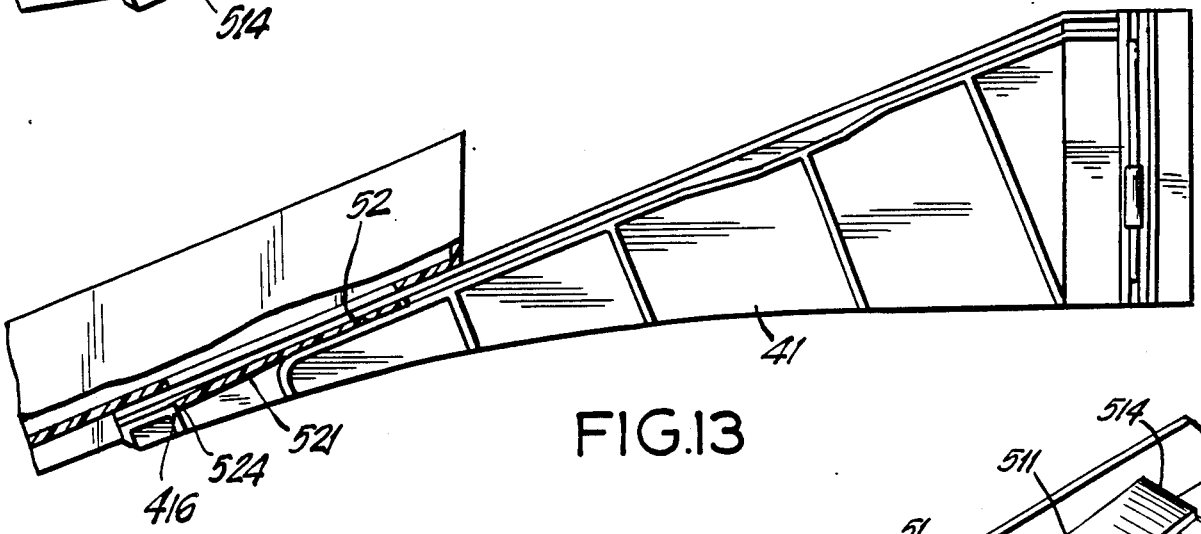
FIG. 13 is a sectional view showing the tray and side support element with the tray in the loading position.

When it is desired to move the tray from the display position shown in FIG. 12 to the loading position shown at the far right in FIG. 1 and in FIG. 13, the user reaches below the tray and presses member 511 (and the corresponding member 511' on the other side, which is not shown) so as to disengage the leading edge 514 from detent 416. The tray is now permitted to freely slide forward until leading edge 524 encounters detent 416 whereupon any further forward movement of the tray is prevented and the tray is positioned as shown in FIG. 13.

At this point the product can be rotated within the tray and a new product can be added to the rear of the tray. When the user desires to move the tray back into the display position, the user need merely push the tray rearwardly until member 511 clicks into place with detent 416.

It will be appreciated that the instant specification and claims are set forth by way of illustration and not limitation, and that various modifications and changes may be made without departing from the spirit and scope of the present invention.

What is claimed is:

1. In an integrated modular store fixture system having at least two spaced apart parallel vertical members with side surfaces facing each other and having a series of aligned holes therein and means engaging holes in two members for holding merchandise to be displayed at the front of the system, the improvement wherein the means for engaging the holes comprises:two side support elements, each extending from the rear to the front of the system when in a mounted position with one end at the rear having means forming members projecting transverse to the support elements and each projecting member inserted in one hole in one vertical member; means for releasably retaining the side support elements in the mounted position comprising a horizontal elongated stretcher member having two downwardly depending pins and means disposed on each side support element for slidably receiving one pin; and means mounted on the side support elements for holding merchandise to be displayed.

2. The system according to claim 1, wherein each side support element comprises a wire frame having a rear portion comprising a right triangle with one side forming a base, another side forming said one end and the hypotenuse above the base and a linear front portion extending downwardly from the hypotenuse to a free end.

3. The system according to claim 2, wherein the means forming projecting meers for each side support element comprises a C-shaped member having two arms extending from a connecting member, wherein the connecting member forms said another side of the triangle and the two arms from the projecting members.

4. The system according to claim 3, wherein the means for slidably receiving one pin comprises a tubular member fixed to each said connecting member.

5. The system according to claim 4, wherein the stretcher member comprises a C-shaped elongated member having two arms forming the pins and configured to be received in the tubular members and a portion connecting the two arms.

6. The system according to claim 5, wherein the means for holding the merchandise to be displayed comprises a bar connecting the free ends of the front portions of the wire frames and at least one J-hook releasably engageable with the bar for holding merchandise to be displayed.

7. The system according to claim 1, wherein each side support element has an inside face and means forming a slide channel sloping downwardly from the rear to the front of the system and means forming a detent along the slide channel at a lower front portion thereof.

8. The system according to claim 7, wherein the means for holding merchandise to be displayed comprises a tray having front and rear portions two sides and a base and means forming two slide members at both sides and under the base of the tray and slidably received in the slide channels of two side support elements, wherein one slide member is disposed at the front portion at both sides and one slide member is disposed at the rear portion at both sides and wherein the slide members are resilient and each includes a rear portion parallel to the base and a front portion depending downwardly at an acute angle from the rear portion and having a leading edge coactive with the detent to prevent forward movement of the tray and manually bendable upwardly to move the leading edge above the detent and permit forward movement of the tray, whereby the tray is movable between a display position wherein the slide members at the front portion of the tray coact with the detents and a leading position wherein the slide members at the rear portion of the tray coact with the detents.

9. The system according to claim 8, wherein the means forming the slide channel includes means forming a relaxation area in the channel at a rear portion thereof comprising a widening of the channel and wherein the relaxation area corresponds to the position of the front portions of the rear slide members when the tray is in the display position.

10. The system according to claim 9, wherein each side support element comprises an integral member comprising the means forming the slide channel and detents and wherein the member includes a rear portion having a vertical channel in the inside face with two spaced through holes to the outside face.

11. The system according to claim 10, wherein the means forming projecting members for each side support element comprises a C-shaped member having two arms extending from a connecting member, wherein the connecting member is received in the vertical channel and the two arms extend through the through holes and from the projecting members.

12. The system according to claim 11, wherein the means for slidably receiving one pin comprises a tubular member fixed to each said connecting member.

13. The system according to claim 12, wherein the stretcher member comprises a C-shaped elongated member having two arms forming the pins and configured to be received in the tubular members and a portion connecting the two arms.

14. A display assembly for use in an integrated modular store fixture system having at least two spaced apart parallel vertical members at the rear of the system with side surfaces facing each other and having a series of aligned holes therein, the assembly comprising: two side support elements each comprising a frame having a rear portion comprising a right triangle with one side forming a base, another side forming a rear end and the hypotenuse above the base and a linear front portion extending downwardly from the hypotenuse to a free end, a C-shaped member having two arms extending from a connecting member, wherein the connecting member forms said another side of the triangle and the two arms form projecting members for insertion into holes in the vertical members of a system, and a tubular member fixed to said connecting member in parallel therewith; a stretcher member comprises a C-shaped elongated member having two arms forming the pins and configured to be received in the tubular members and a portion connecting the two arms; and a bar connecting the free ends of the front portions of the wire frames and on which at least one J-hook is releasably engageable for holding merchandise to be displayed.

15. A pull-out tray assembly for use in an integrated modular store fixture system having at least two spaced apart parallel vertical members at the rear of the system with side surfaces facing each other and having a series of aligned holes therein, the assembly comprising: two side support elements, each having an inside face and means forming a slide channel sloping downwardly from a rear portion to a front portion of the assembly and means forming a detent along the slide channel at a lower front portion thereof, the rear portion having a vertical channel in the inside face with two spaced apart through holes to the outside faces, a C-shaped member having two arms extending from a connecting member, wherein the connecting member is received in the vertical channel and the two arms extend through the through holes and engage holes in vertical members of a system; a tubular member fixed to each said connecting member in parallel therewith; a stretcher member comprising a C-shaped elongated member having two arms configured to be received in the tubular members and a portion connecting the two arms; a tray having front and rear portions, two sides and a base and means forming two slide members at both sides and under the base of the tray and slidably received in the slide channels of two side support elements, wherein one slide member is disposed at the front portion at both sides and one slide member is disposed at the rear portion at both sides and wherein the slide members are resilient and each includes a rear portion parallel to the base and a front portion depending downwardly at an acute angle from the rear portion and having a leading edge coactive with the detent to prevent forward movement of the tray and manually bendable upwardly to move the leading edge above the detent and permit forward movement of the tray, whereby the tray is movable between a display position wherein the slide members at the front portion of the tray coact with the detents and a loading position wherein the slide members at the rear portion of the tray coact with the detents.

16. The assembly according to claim 15, wherein the means forming the slide channel includes means forming a relaxation area in the channel at a rear portion thereof comprising a widening of the channel and wherein the relaxation area corresponds to the position of the front portions of the rear slide members when the tray is in the display position.

* * * * *